US007653331B2

(12) United States Patent
Gross et al.

(10) Patent No.: US 7,653,331 B2
(45) Date of Patent: Jan. 26, 2010

(54) TRANSFER BELT MODULE STEERING TO OPTIMIZE CONTACT FORCES AT TRANSFER BELT AND PHOTORECEPTOR BELT INTERFACE

(75) Inventors: Eric M. Gross, Rochester, NY (US); Charles A. Radulski, Macedon, NY (US)

(73) Assignee: Xerox Corporation CT (US)

( * ) Notice: Subject to any disclaimer, the term of this patent is extended or adjusted under 35 U.S.C. 154(b) by 0 days.

(21) Appl. No.: 12/132,129

(22) Filed: Jun. 3, 2008

(65) Prior Publication Data

US 2009/0297221 A1 Dec. 3, 2009

(51) Int. Cl.
*G03G 15/00* (2006.01)

(52) U.S. Cl. ..... 399/165; 399/162; 399/66; 399/297

(58) Field of Classification Search ..... 399/165, 399/162

See application file for complete search history.

(56) References Cited

U.S. PATENT DOCUMENTS

| | | | | |
|---|---|---|---|---|
| 5,077,795 | A | 12/1991 | Rourke et al. | |
| 5,296,904 | A | 3/1994 | Jackson | |
| 6,088,558 | A * | 7/2000 | Yamada et al. | 399/165 |
| 7,242,894 | B2 | 7/2007 | Kuo et al. | |
| 2004/0052555 | A1 | 3/2004 | Berkes et al. | |
| 2004/0146796 | A1 | 7/2004 | Gross et al. | |
| 2005/0095024 | A1 | 5/2005 | Gross et al. | |
| 2006/0034634 | A1 | 2/2006 | Yu | |
| 2006/0104678 | A1 * | 5/2006 | Kuo et al. | 399/313 |
| 2006/0245773 | A1 | 11/2006 | Gross et al. | |
| 2007/0183821 | A1 | 8/2007 | Parks | |
| 2008/0088691 | A1 | 4/2008 | Fitzpatrick et al. | |
| 2008/0089703 | A1 | 4/2008 | Calamita | |

* cited by examiner

*Primary Examiner*—David M Gray
*Assistant Examiner*—Roy Yi
(74) *Attorney, Agent, or Firm*—Ronald E. Prass, Jr.; Prass LLP

(57) ABSTRACT

According to aspects of the embodiments, there is provided methods of optimizing contact forces between transfer and photoreceptor belts in image forming devices. The method acquires initial and operational set point data for the photoreceptor and transfer belt at different stages of engagement. Yaw motion is applied to reduce any misalignment between the belts based on the acquired data. A processor is used to determine misalignment between the photoreceptor belt and the transfer belt, and an actuator can be used to apply yaw motion. The yaw motion can return the transfer belt and the photoreceptor belt to their initial set position, or return a steering subsystem actuator to its setting prior to engagement of the belts. Set point data can be from the respective transfer steering subsystem for the photoreceptor and the transfer belts.

15 Claims, 4 Drawing Sheets

TRANSFER BELT MODULE STEERING TO OPTIMIZE CONTACT FORCES AT TRANSFER BELT AND PHOTORECEPTOR BELT INTERFACE

BACKGROUND

The disclosure is directed to an image forming devices and, more particularly, to a method and an apparatus for correcting transfer and photoreceptor belt misalignment in an image forming device.

Apparatuses that form images on a sheet, such as electrophotographic reproduction machine and printers are equipped with mechanisms to rotate a continuous belt at various locations inside the apparatus. The continuous belts used in conjunction with such mechanisms include a photoreceptor belt and transfer belt. Flexible electrostatographic belt imaging members are well known in the art. Typical electrostatographic flexible belt imaging members include, for example, photoreceptors for electrophotographic imaging systems; electroreceptors or flexible ionographic imaging members for electrographic imaging systems; and flexible intermediate transfer belts for transferring toner images in electrophotographic and electrographic imaging systems.

To insure proper operation of the flexible electrostatographic belt imaging members it is important to limit shifts along the axes of rotation and lateral position as it rotates. Shifts in lateral position results in imaging degradation and damage, with repeated operations, to the belt itself. A source of shifting in lateral position can arise when the photoreceptor belt and transfer belt interact. This belt interaction creates a meandering force or contact force that leads to misalignment or shifting of the belt in a lateral position. The misalignment causes the edge portions of the respective belts to be damaged by the meandering belts. Another source is differences in speed of the belts, too much velocity variation or misalignment can cause belt ripple, image distortion, or abrasive degradation.

SUMMARY

According to aspects of the embodiments, there is provided methods of optimizing contact forces between transfer and photoreceptor belts in image forming devices. The method acquires initial and operational set point data for the photoreceptor and transfer belt at different stages of engagement. Yaw motion is applied to reduce any misalignment between the belts based on the acquired data. A processor is used to determine misalignment between the photoreceptor belt and the transfer belt, and an actuator can be used to apply yaw motion. The yaw motion can return the transfer belt and the photoreceptor belt to their initial set position, or return a steering subsystem actuator to its setting prior to engagement of the belts. Set point data can be from the respective transfer steering subsystem for the photoreceptor and the transfer belts.

DETAILED DESCRIPTION

Aspects of the disclosed embodiments relate to methods for optimizing contact forces between transfer and photoreceptor belts, and corresponding apparatus to reduce misalignment between interacting belts and image forming device with controller to reduce misalignment between photoreceptor and transfer belts. The disclosed embodiments minimize misalignment that could cause belt ripple, image distortion or abrasive degradation. The disclosed embodiments provide a lateral adjustment (yaw motion) on the bias transfer module (BTB) module assembly so the speed of the interacting belts can be synchronized and misalignment reduced.

The disclosed embodiments include methods for optimizing contact forces between a transfer belt and a photoreceptor belt by applying yaw motion to the bias transfer module when misalignment is found to have occurred. The yaw motion acts to bring either the transfer belt or the photoreceptor belt to a position where misalignment is minimized.

The disclosed embodiments further include an apparatus having a back up roll and bias roll positioned to form a nip. A print media and portions of the transfer and the photoreceptor belts move through the formed nip. An aptly programmed processor \controller is provided to determine if misalignment exist between the transfer belt and the photoreceptor belt. If a misalignment is determined, an actuator is used to apply yaw motion to reduce the misalignment.

The disclosed embodiments further include an image forming device consisting of a plurality of rollers mounted to a frame, a photoreceptor belt, a transfer belt, and processors and controller for minimizing misalignment between the belts.

Figure 1:
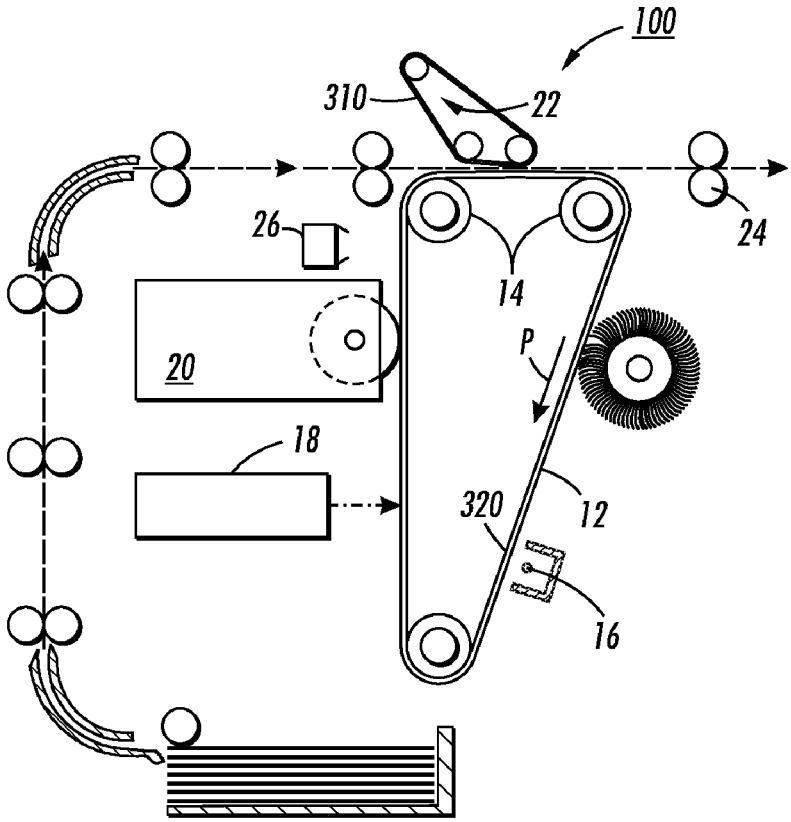
FIG. 1 illustrates an image forming device in accordance with one possible embodiment.

FIG. 1 is an exemplary diagram of a printing system 10 that includes a photoreceptor 12 which may be in the form of a belt or drum and which includes a charge retention surface. The photoreceptor 12 may be entrained on a set of rollers 14 and caused to move in a counter-clockwise process direction by means such as a motor (not shown).

A printing process such as an electrophotographic process must charge the relevant photoreceptor surface. The initial charging may be performed by a charge source 16. The charged portions of the photoreceptor 12 may then be selectively discharged in a configuration corresponding to the desired image to be printed by a raster output scanner (ROS) 18. The ROS 18 may include a laser source (not shown) and a rotatable mirror (also not shown) acting together in a manner known in the art to discharge certain areas of the charged photoreceptor 12. It should be appreciated that other systems may be used for this purpose including, for example, an LED bar or a light lens system instead of the laser source. The laser source may be modulated in accordance with digital image data fed into it and the rotating mirror may cause the modulated beam from the laser source to move in a fast scan direction perpendicular to the process direction of the photoreceptor 12. The laser source may output a laser beam of sufficient power to charge or discharge the exposed surface on photoreceptor 12 in accordance with a specific machine design.

After selected areas of the photoreceptor 12 are discharged by the laser source, remaining charged areas may be developed by developer unit 20 causing a supply of dry toner to contact the surface of photoreceptor 12. The developed image may then be advanced by the motion of photoreceptor 12 to a transfer station including a transfer device 22, causing the toner adhering to the photoreceptor 12 to be electrically transferred to a print media or substrate, which is typically a sheet of paper, to form the image thereon. The sheet of paper with the toner image may then pass through a fuser 24, causing the toner to melt or fuse into the sheet of paper to create a permanent image.

As shown, a densitometer 26 may be used after the developing step to measure the optical density of the halftone density test patch created on the photoreceptor 12 in a manner known in the art. A tone reproduction curve (TRC) or tone reproduction table (TRT) can be used with the data from the densitometer to ascertain the quality of the print. As used herein, the densitometer is intended to apply to any device for determining the density of print material on a surface, such as a visible light densitometer, an infrared densitometer, an electrostatic voltmeter, or any other such device that makes a physical measurement from which the density of print material may be determined.

Figure 2:
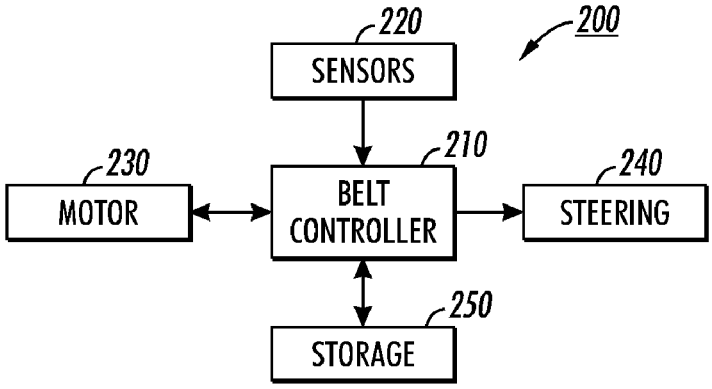
FIG. 2 illustrates a belt driving subsystem in accordance with one possible embodiment.

FIG. 2 illustrates a belt driving system 200 in accordance with a possible embodiment of the invention. Belt driving system 200 is included to illustrate the main components of a transfer belt steering subsystem (TBSS) and photoreceptor belt steering subsystem PBSS). In particular, the belt driving system (TBSS or PBSS) 200 comprises belt controller 210, sensors 220, motor 230, steering 240, and storage devices. The belt controller 210 may be implemented with a general-purpose processor. However, it will be appreciated by those skilled in the art that the belt controller 210 may be implemented using a single special purpose integrated circuit (e.g., ASIC, FPGA, or the like) having a main or central processor section for overall, system-level control, and separate sections dedicated to performing various different specific computations, functions and other processes under control of the central processor section. Further, belt controller 210 may be a plurality of separate dedicated or programmable integrated or other electronic circuits or devices. Here, as one skilled in the art would appreciate, the belt may be one of a photoreceptor belt, a transfer belt, a drying belt, a fusing belt, a returning belt, or the like.

The sensors 210 can include one or more light source with one or more photodetector, strain gauge, or any other position-determining sensor that outputs position data in accordance with detected position-determining marks on a belt that can be detected by the position-determining sensor. A suitable light source could be one or more light emitting diode (LED). Regardless of the type of sensor used the signal from each individual sensor is a digital representation of the belt's current lateral position, with an accuracy defined by the sensor or the distance between two adjacent sensors when used in combination to determined position. Furthermore, position-determining marks with an encoder can generate a belt-conveying signal indicative of the belt movement in the conveying direction. Various sensors and methodologies can provide the controller with a real-time indication of the lateral position and the speed of each belt.

The motor 230 is inclusive of a driving mechanism that can comprise driving rollers that rotate and drive a belt, a driving motor that provides a driving force to a driving roller, and a driving motor controller that controls a driving motor to maintain the speed of the motor and to limit transient conditions.

The steering 240 is inclusive of a steering motor controller that can control the positioning of the belt based on data from sensors 220, belt controller 210, and storage device 250. Storage device 250 stores data including minimum weaving of a belt, initial belt position, initial set point data, position of the steering roller that corresponds to a position of a belt in real-time, and a snapshot of operational data that indicates the operation of the belt. This data is made available to all processing systems in image forming device 100.

Figure 3:
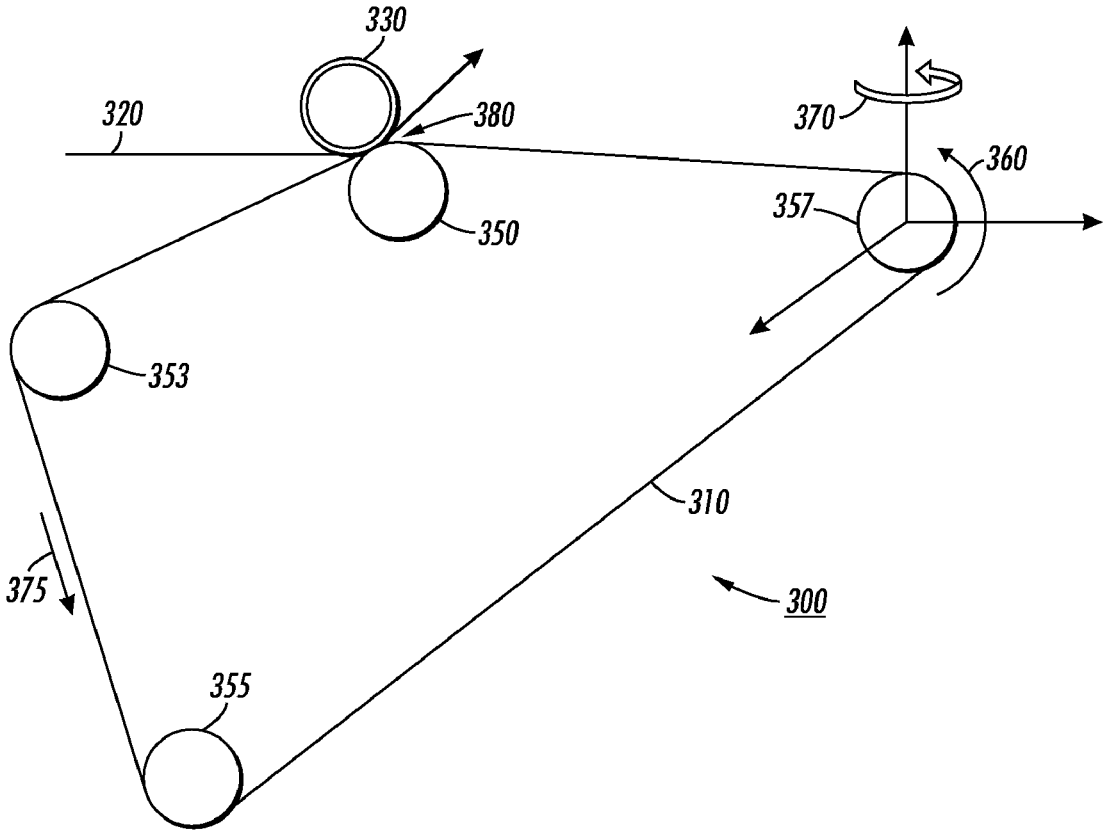
FIG. 3 illustrates a bias transfer belt (BTB) system with photoreceptor belt interaction in accordance with one possible embodiment of the invention.

FIG. 3 illustrates a bias transfer belt (BTB) system 300 with photoreceptor belt interaction in accordance with one possible embodiment of the invention. In particular, bias transfer belt system 300 includes a plurality of rollers (350, 353, 355, 357) and a transfer belt 310. The movement of the transfer belt is shown by direction 375. The direction 375 or rotation is set by steering rollers or driving rollers under the control of a processor/controller such as belt steering subsystem 200. As shown driving roller rotates in a counter clockwise direction 375.

The transfer belt 310 interacts with photoreceptor belt 320 and back up roll 330. As noted above in FIG. 2 sensors in the image reproduction device 100 monitor the lateral and axial positions of the belts. As noted earlier photoreceptor belt 320 forms part of photoreceptor 12 shown in FIG. 1. BTB system 300 is installed to move and be interlocked by the operation of a cam mechanism (not shown) driven by a steering motor such as motor 230. As known to those in the art, a cam mechanism includes a pivoting lever and a cam. The function of a pivoting lever is to pivot with respect to a pivoting axis 360 by rotation of a cam. The pivoting axis 360 is an axial motion that engages or disengages the belts. For example, the transfer belt module can be pivoted away (clockwise in FIG. 3) from the photoreceptor belt 320 to remove paper jams or to remove transfer belt 310 or photoreceptor belt 320. Likewise, the transfer belt module could be moved towards the photoreceptor belt so as to engage and lock the module in position. Initially, the photoreceptor and lateral belts are not engaged so that the belt steering subsystem (FIG. 2) can acquire the initial set point for the respective belt. Initial set point can be the first lateral position of the belt, the initial speed of the belt, or the initial forces acting on the respective belt. In operation, the photoreceptor and lateral belts are in a locked position (engaged). In the locked position, the belts exert an equal but opposite force on each other.

The pressing of back up roll 330 against bias roll 350 causes a nip 380 to form between the photoreceptor belt 320 and the transfer belt 310. Engagement and disengagement of the respective nips is automated by at least one actuator, such as a cam and stepper motor mechanism, where the at least one actuator is controlled by controller 840. At the nip, the belts pressed against each other and upon contact, equal and opposite forces will act to disturb the belt steering regulation for each belt mechanism. The magnitude of each belt steering subsystem 200 response is expected to be different, but in opposite directions.

The presence of a greater than zero relative velocity component is inferred by the required belt steering control actions of the photoreceptor and transfer belt steering subsystems. Belt interaction and variations in the manufacturing of components have been known to give rise to a greater than zero relative velocity. Regardless of the cause, velocity differences between the photoreceptor belt and transfer belt could cause belt ripple, image distortion/degradation or abrasive action to occur. An appropriate measure of transfer belt abrasive action is given by the following equation:

$$ABRACT=N_L*M*B_C$$

Where $N_L$ is the length of the nip 380 formed between the rolls; M is the misalignment angle between the belts; and, $B_C$ is the number of belt cycles. So for an expected nip length of 4 mm ($4\times10^{-3}$), a misalignment angle of one degree ($17.45\times10^{-3}$ radians); and one mega cycles at the photoreceptor belt. A transfer belt slips with respect to the photoreceptor by 70 meters. Variations in the manufacturing process such as in the motor or gear mechanism can be handled by the individual belt steering subsystem. The greater than zero relative velocity due to belt interaction can be managed by minimizing the misalignment of the belts.

Figure 4:
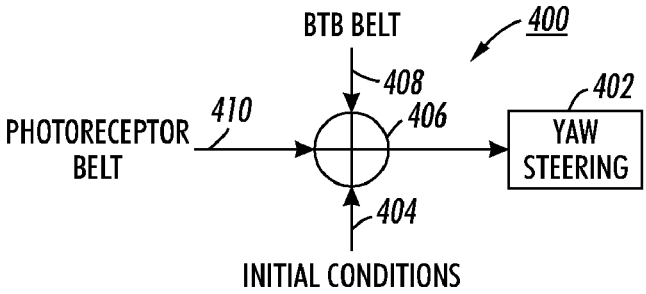
FIG. 4 illustrates an apparatus for regulating belt misalignment in accordance with one possible embodiment.

FIG. 4 is an apparatus 400 for regulating belt misalignment in accordance with one possible embodiment. In particular, the apparatus consist of BTB belt signals 408, PR belt signals 410, initial conditions signal 404, an arithmetic processing device 406, and a yaw steering mechanism 402. The initial conditions signal 404 is the initial set point for the transfer belt 310 and the initial set point for the photoreceptor belt 320. The initial conditions can be sent from the respective belt steering subsystem or the initial conditions could be from a memory device such as storage device 250 in FIG. 2. The BTB belt signal could be realtime signals from the transfer belt steering subsystem. Additionally, the BTB signal could be sent to apparatus 400 at regular intervals, after certain milestones such as after N revolutions, or sent after a triggering event defined by a user through controller 800. The PR belt signal could follow the same schedule as the BTB belt signal. After the signals are received at arithmetic processing device 406, they are subjected to a mathematical operation to determine the misalignment of the belts. The result of the operation is sent to yaw steering mechanism 402 for processing in accordance to the determination. Yaw steering mechanism can be a motor or an actuator controlled by the received control signals (e.g., pulse width signals).

Applying lateral motion to either belt is one way for correcting misalignment between the photoreceptor belt 320 and the transfer belt. Yaw motion as used herein includes lateral motion and controlling the respective belt steering mechanism. Yaw motion could be used to return the belts to their set points prior to engagement. In the alternative or in combination with returning the belts to their set points prior to engagement, the yaw motion could return each belt steering subsystem actuator to its setting prior to engagement. As shown in FIG. 3, yaw motion 370 is being applied to roller 357 so as to move transfer belt 310 to a position other than its current position.

Yaw steering mechanism 402 is any rod or actuator that can apply a lateral force to the transfer or photoreceptor belt so as to minimize misalignment. Yaw steering mechanism 402 can be a respective belt steering subsystem 200 or actuators in the respective belts.

Figure 5:
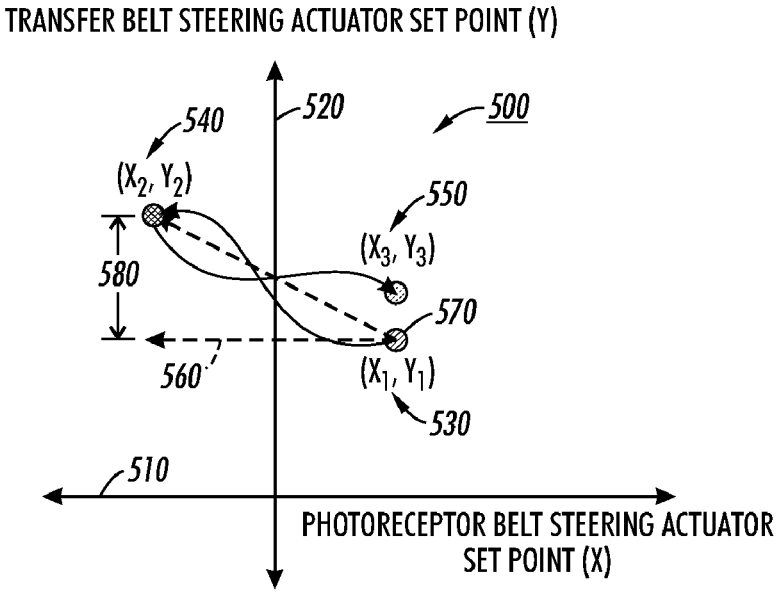
FIG. 5 is a graphical representation of set point variables for a transfer belt and a photoreceptor belt in accordance with one possible embodiment.

FIG. 5 is a graphical representation 500 of set point variables for a transfer belt and a photoreceptor belt in accordance with one possible embodiment.

In particular, graphical representation 500 shows an X-Y axis of photoreceptor belt steering actuator set point 510 and transfer belt steering actuator set point 520. Image forming device 100 is initially adjusted prior to contact between the transfer belt and photoreceptor belt. Points $X_1$ and $Y_1$ represent initial setpoint 530 for both subsystems. Upon contact, equal and opposite forces will act to disturb the belt steering regulation algorithm for the transfer and photoreceptor belts. The magnitudes of each subsystem responses are expected to be different, but in opposite directions. It is assumed that each belt steering algorithm has a sensor that provides position feedback at sufficient resolution. Points $X_2$ and $Y_2$ represent the operational set point 540 for both subsystems.

The difference between the set points represents the misalignment of the belts. The misalignment of the belts can be reduced by changing the set point of the belt steering subsystem. Points $X_3$ and $Y_3$ represent the corrected set point 550 for both subsystems. It should be noted, that the overall strategy of lowering misalignment between the belts can be accomplished by changing one or all the set points of the respective belt steering subsystem. Placing an actuator on the transfer belt module or the photoreceptor belt module would change the set point for that module. In FIG. 3, yaw motion 370 is caused by an actuator perturbing or dithering the transfer belt module by application of a lateral force. The lateral force would move, in this case, the transfer module frame in a direction that is perpendicular to the motion of the belt. The lateral force would move the position of the belt and would introduce a new set point that should have an effect on the misalignment determination. Point 550 bears out such a strategy where the belt steering actuator point (Y) is changed while the photoreceptor belt steering (X) is kept constant (Unchanged).

Misalignment between the belts can be viewed as a difference in belt velocity 580. Vector 560 represents the vector components for transfer belt velocity and photoreceptor belt velocity. Angle 570 is a measure of the misalignment between the belts. Angle 570 is the slip velocity between the belts.

Figure 6:
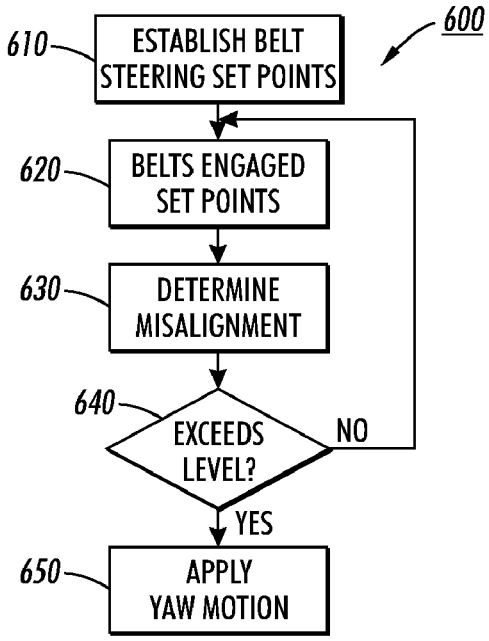
FIG. 6 is a flowchart of a method for applying yaw motion in accordance with one possible embodiment.

FIG. 6 is a flowchart of method 600 for applying yaw motion in accordance with one possible embodiment. Method 600 can be implemented as computer-executable instructions or data structures stored in a computer-readable medium. Method 600 begins with the acquisition of initial set points for the transfer belt and the photoreceptor belt. Once the initial conditions are acquired control passes to action 620 for further processing. In action 620, the operational set points are acquired for the transfer belt and the photoreceptor belt. It should be noted that value acquisition for the belts need not be in realtime or sequential. The values could be acquired at different points or from a suitable storage device such as storage device 250 in FIG. 2. It is foreseeable that the operation set point could be used as an impetus for acquiring/reacquisition of the initial set point.

In action 630, a misalignment is determined. As noted above with reference to FIG. 5, misalignment can be the difference in initial and operational set point as determined by the respective belt steering subsystems, or greater than zero relative velocity as illustrated by angle 570. In optional action 640, a determination is made as to whether or not the calculated misalignment exceeds a predetermined value. If the misalignment is within acceptable levels control is returned to action 620 for further processing. If the misalignment is beyond an acceptable level then control passes to action 650 for further processing. In action 650, yaw motion is applied to the respective belts. As noted earlier, yaw motion could be the changing of the set point at either the transfer belt steering subsystem or the photoreceptor belt steering subsystem value. Further, yaw steering could be a lateral force signal that causes an actuator to return the transfer or photoreceptor belt to an initial lateral position. The lateral signal could be used by an actuator to dither, displace, or perturb the belt to its original position.

Figure 7:
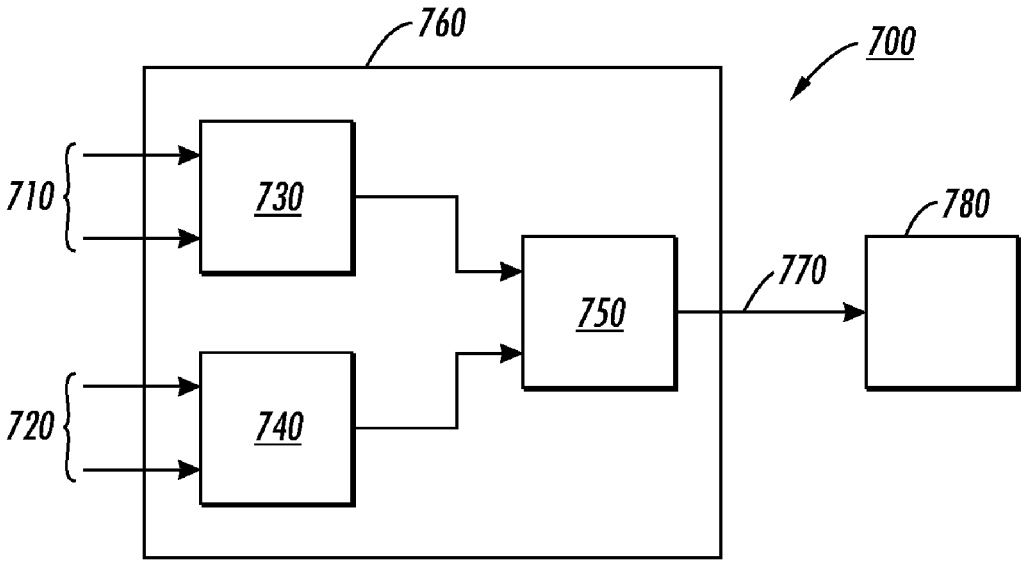
FIG. 7 illustrates a block diagram of an apparatus for applying yaw motion in accordance with one possible embodiment.

FIG. 7 illustrates a block diagram of an apparatus 700 for applying yaw motion in accordance with one possible embodiment. In particular apparatus 700 comprises photoreceptor belt input signal 710, lateral belt input signal 720, first processor 730, second processor 740, controller 750, yaw control module 760, lateral control signal 770, and actuator 780.

Photoreceptor belt input signal 710 is processed by first processor 730 to determine the deviation of the photoreceptor belt from an initial position. Transfer belt input signal 720 is processed by second processor 740 to determine the deviation of the transfer belt from an initial position. The deviation of the respective belts, as determined by the first processor 730 and second processor 740, is then processed by controller 750 so as to determine misalignment of the belts. The first processor 730, second processor 740, and controller 750 could be encased in a yaw control module 760. Controller 750 generates a lateral force signal 770 that when acted upon causes the actuator 780 to apply yaw motion to an attached belt module such as transfer belt 310 shown in FIG. 3.

Figure 8:
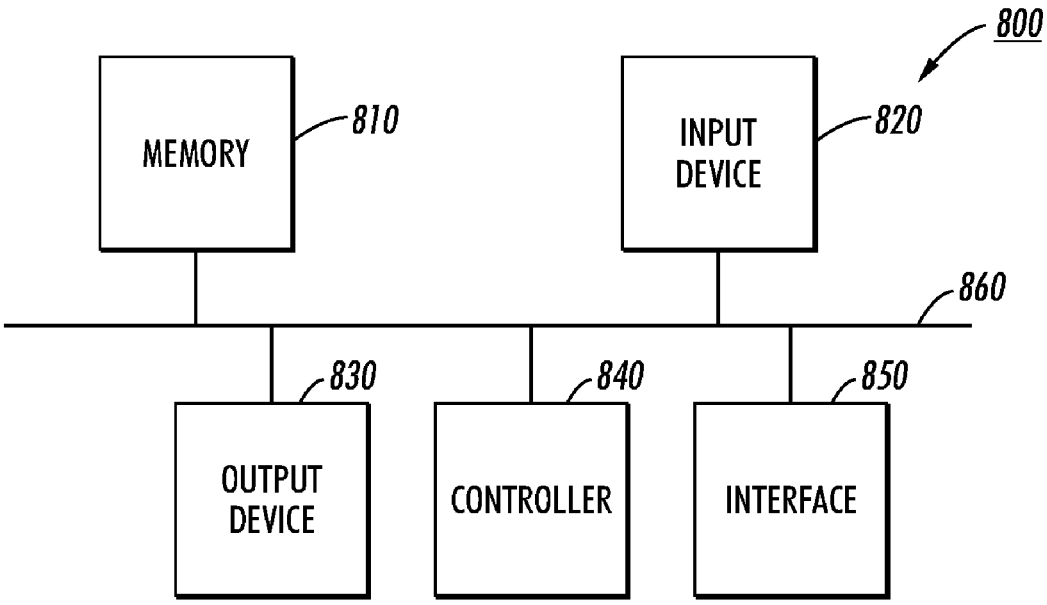
FIG. 8 illustrates a detailed diagram of circuitry of a controller in accordance with one possible embodiment.

FIG. 8 is an exemplary detailed diagram of circuitry of a controlling device 800 that may be used to control yaw motion like controller 750 or belt steering like belt controller 210. The controlling device 800 may include a memory 810, an input device 820, an output device 830, a controller 840, and an interface 850. The devices 810-850 may be connected via a bus 860. The input device 820 may be any device that may allow commands to be inputted into the controlling device 800 so that it can control an attached device such as actuator 760. The output device 830 may be any device that allows, for example, images to be recorded on a medium or shown on a display. The memory 810 may be any device that allows data or information to be stored. The interface 850 may allow the devices 810-850 to communicate with each other and with various devices within the image forming device 100.

In the illustrated embodiment, the controller 840 may be implemented with a general-purpose processor. However, it will be appreciated by those skilled in the art that the controller 840 may be implemented using a single special purpose integrated circuit (e.g., ASIC, FPGA) having a main or central processor section for overall, system-level control, and separate sections dedicated to performing various different specific computations, functions and other processes under control of the central processor section. The controller 840 may be a plurality of separate dedicated or programmable integrated or other electronic circuits or devices (e.g., hardwired electronic or logic circuits such as discrete element circuits, or programmable logic devices such as PLDs, PLAs, PALs or the like). The controller 840 may be suitably programmed for use with a general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller 840. A distributed processing architecture can be used for maximum data/signal processing capability and speed.

Embodiments as disclosed herein may include computer-readable medium for carrying or having computer-executable instructions or data structures stored thereon. Such computer-readable medium can be any available medium that can be accessed by a general purpose or special purpose computer. By way of example, and not limitation, such computer-readable medium can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable medium.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. The instructions for carrying out the functionality of the disclosed embodiments may be stored on such a computer-readable medium.

The instructions from a computer-readable medium may be used by an electronic device, such as controllers 210, 750, 800, to cause the functionality of the embodiments to occur. These instructions may be loaded into a memory to be executed by a processor as needed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of controlling contact forces between a transfer belt and a photoreceptor belt, the method comprising:

acquiring transfer belt initial set point and photoreceptor belt initial set point when not engaged;

acquiring transfer belt operational set point and photoreceptor belt operational set point when not engaged;

determining transfer belt and photoreceptor belt misalignment after engagement from the acquired initial set points and the acquired operational set points; and applying yaw motion to reduce misalignment between the transfer belt and photoreceptor belt;

wherein initial set points are acquired when the transfer belt and the photoreceptor belt are not engaged;

wherein operational set points are acquired when the transfer belt and the photoreceptor belt are engaged.

2. The method of claim 1, wherein the initial set point and the operational set point for the transfer belt are provided by a transfer steering subsystem; and wherein the initial set point and the operational set point for the photoreceptor belt are provided by a photoreceptor steering subsystem.

3. The method of claim 2, wherein applying yaw motion is returning the transfer belt and the photoreceptor belt to their initial set position.

4. The method of claim 2, wherein applying yaw motion is returning the transfer belt to its initial set position.

5. The method of claim 1, wherein applying yaw motion is returning a transfer steering subsystem actuator to its setting prior to engagement.

6. The method of claim 1, wherein applying yaw motion is returning a photoreceptor steering subsystem actuator to its setting prior to engagement.

7. The method of claim 1, wherein a set point comprises at least lateral belt position for the transfer belt and the photoreceptor belt.

8. The method of claim 7, wherein yaw motion is in a direction substantially perpendicular to the direction of motion for the transfer belt.

9. An apparatus comprising:

a back up roll having an outer surface;

a bias roll adjacent said outer surface of said back up roll, wherein said bias roll is positioned with respect to said back up roll to form a nip between said bias roll and said back up roll;

a photoreceptor belt, wherein a portion of said photoreceptor belt is in said nip between said bias roll and said back up roll;

a transfer belt, wherein a portion of said transfer belt is in said nip between said bias roll and said photoreceptor belt;

a processor with sensors to determine misalignment between the photoreceptor belt and the transfer belt based on actuator adjustment changes between engaged and non engaged configurations; and an actuator capable of applying yaw motion to reduce misalignment between the transfer belt and photoreceptor belt;

wherein the processor determines misalignment from data consisting of initial set point data and operational set point data for the photoreceptor belt and the transfer belt, and wherein initial set point data is acquired when the transfer belt and the photoreceptor belt are not engaged and the operational set point data is acquired when the transfer belt and the photoreceptor belt are engaged.

10. The apparatus of claim 9, wherein applying yaw motion is returning the transfer belt and the photoreceptor belt to their initial set position.

11. The apparatus of claim 9, wherein applying yaw motion is returning the transfer belt to its initial set position.

12. The apparatus of claim 9, wherein a set point comprises at least lateral belt position for the transfer belt and the photoreceptor belt.

13. The apparatus of claim 12, wherein yaw motion is in a direction substantially perpendicular to the direction of motion for the transfer belt.

14. An image forming device comprising:

a plurality of rollers mounted to a frame for defining a path along which a transfer belt is driven in a process direction, the plurality of rollers comprising a drive roller having a longitudinal axis about which it is mounted to rotate and a drive surface formed generally concentrically about the longitudinal axis;

a photoreceptor belt configured to have a charge placed thereon for modification by an imager to be receptive to a charged toner, wherein a portion of said photoreceptor belt is in a nip formed between a bias roll and a back up roll;

a first processor to detect a first lateral position of the photoreceptor belt and to detect a second lateral position of the photoreceptor belt;

a second processor to detect a first lateral position of the transfer belt and to detect a second lateral position of the transfer belt; and controller to determine misalignment between the photoreceptor belt and the transfer belt from detected lateral position data, wherein the misalignment is based on a change of lateral positions of the photoreceptor belt and the transfer belt and the first lateral position is when the photoreceptor belt and the transfer belt are not engaged, and where the second lateral position is when the photoreceptor belt and the transfer belt are engaged.

15. The image forming device machine of claim 14, wherein the controller generates a lateral force signal to return the transfer belt to the first lateral position.

* * * * *